US006824070B2

(12) United States Patent
Halverson et al.

(10) Patent No.: US 6,824,070 B2
(45) Date of Patent: Nov. 30, 2004

(54) CROSS-TIE FOR RAILROAD RAIL ASSEMBLY AND METHOD OF MANUFACTURING THE SAME

(75) Inventors: Rick Halverson, New Berlin, NY (US); Martin Diamond, Erieville, NY (US)

(73) Assignee: ARE Technologies of Central New York, Inc., Cazenovia, NY (US)

( * ) Notice: Subject to any disclaimer, the term of this patent is extended or adjusted under 35 U.S.C. 154(b) by 0 days.

(21) Appl. No.: 10/476,112

(22) PCT Filed: Apr. 24, 2002

(86) PCT No.: PCT/US02/12919

§ 371 (c)(1),
(2), (4) Date: Oct. 24, 2003

(87) PCT Pub. No.: WO02/090657

PCT Pub. Date: Nov. 4, 2002

(65) Prior Publication Data

US 2004/0129791 A1 Jul. 8, 2004

Related U.S. Application Data

(60) Provisional application No. 60/288,177, filed on May 2, 2001.

(51) Int. Cl.[7] ..... E01B 3/00
(52) U.S. Cl. ..... 238/37; 238/36
(58) Field of Search ..... 238/29, 30, 31, 238/36, 37

(56) References Cited

U.S. PATENT DOCUMENTS

| | | | | |
|---|---|---|---|---|
| 4,286,753 | A | | 9/1981 | Lee |
| 5,746,545 | A | | 5/1998 | Parker, Jr. |
| 5,996,901 | A | * | 12/1999 | Young ..... 238/37 |
| 6,048,129 | A | | 4/2000 | Rue |
| 6,306,484 | B1 | * | 10/2001 | Bove et al. ..... 428/192 |
| 6,316,069 | B1 | | 11/2001 | Bove et al. |
| 6,368,690 | B1 | | 4/2002 | Bove |
| 6,372,069 | B1 | | 4/2002 | Walls |

* cited by examiner

*Primary Examiner*—Mark T. Le
(74) *Attorney, Agent, or Firm*—Burr & Brown

(57) ABSTRACT

A cross-tie for a railroad rail assembly and a method of manufacturing the same, wherein the cross-tie includes a plurality of recycled tire treads stacked along one of the width and height dimensions of the cross-tie, and secured to one another via an interposed adhesive material.

20 Claims, 2 Drawing Sheets

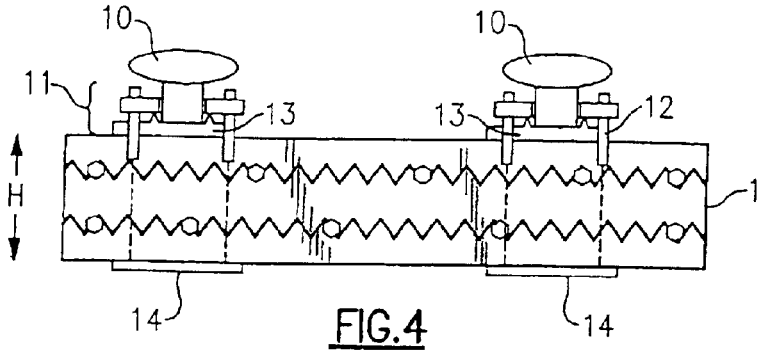
FIG.4
FIG.5
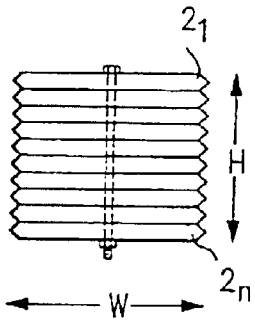
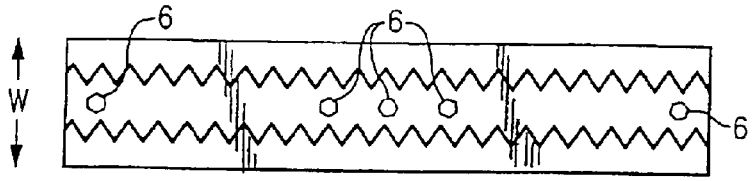
FIG.6
FIG.7
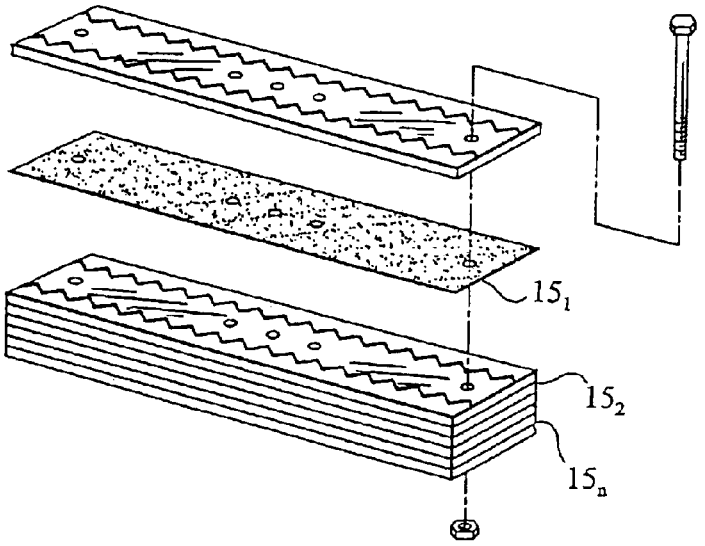

CROSS-TIE FOR RAILROAD RAIL ASSEMBLY AND METHOD OF MANUFACTURING THE SAME

This application claims the benefit of Provisional Application No. 60/288,177, filed May 2, 2001.

FIELD OF THE INVENTION

The present invention relates to a cross-tie for a railroad rail assembly and its method of manufacture, and, in particular, a cross-tie made from recycled tire treads.

BACKGROUND OF THE INVENTION

Railroad rail assemblies use cross-ties to support the steel rails that carry freight and passenger trains. Historically the cross-ties have been made from wood, and have been treated with creosote. More recently, creosote has been classified as a carcinogen, and most localities have placed severe restrictions on its use, if not banned its use altogether. As a result, creosote-soaked cross-ties have been replaced with pressure treated timbers. Pressure treated timbers, however, have a substantially reduced life expectancy when compared to creosote timbers.

Another problem with wooden cross-ties is their inability to hold the rails they support within "Standard Gauge" for extended periods of time. Cross-ties must have some degree of flexibility in order to deflect under the load of a passing train, and to this extent wooden cross-ties exhibit sufficient support and durability. However, the inherent problem with any wooden tie is its limited useable life due to its tendency to decay when exposed to the elements. Consequently, degeneration of the wooden ties eventually loosens the railroad spikes, allowing the rails to move apart, which could eventually result in derailment. Therefore, the use of wooden cross-ties requires frequent maintenance and replacement. Also, the decay and breakdown of creosote soaked ties is a threat to the environment, in that State Statutes and Local Ordinances have drastically increased the cost associated with disposing of these types of cross-ties.

There have also been attempts to use reinforced concrete cross-ties and steel cross-ties to address some of the problems associated with wooden cross-ties. Concrete cross-ties, however, are expensive compared to wooden cross-ties and are not as flexible as wooden cross-ties. Concrete cross-ties have a tendency to fail under adverse conditions, at which time the cross-tie will need replacement. Accordingly, while concrete cross-ties can be used for "Light Rail" passenger track, they are not as suitable for freight tracks due to the extreme weights inherent in freight trains.

Steel cross-ties have also been used. While steel can handle the heavy weight of freight traffic and will last for long periods of time, steel cross-ties are also expensive compared to wooden cross-ties. In order to insure the integrity of steel cross-ties, frequent inspection and welding is required thus substantially increasing their maintenance costs.

Another known cross-tie is that of U.S. Pat. No. 5,996,901 to Young. The '901 cross-tie includes a stack of elastomeric layers (e.g., recycled tire treads) as a filler layer interposed between and fastened to a pair of rigid plates. The stack and plate assembly is held together by a plurality of wedge-shaped members and fasteners which are fixed to form non-perpendicular angles with the stack. The wedge-shaped members and bolts are positioned at multiple locations along the longitudinal (i.e., length) direction of the cross-tie.

Like the above-mentioned steel cross-ties, the '901 cross-tie assembly is expensive. The expense is attributed not only to the inclusion of the rigid plates (e.g., steel), but also to the high number of wedge-shaped members and bolts required by the design. Ultimately, the design of the '901 cross-time assembly is cost prohibitive.

It would be desirable to provide an environmentally friendly solution to the above-discussed problems with the prior art cross-ties. While several have attempted to provide such a solution, the expense involved has prevented any such solution from coming to fruition.

SUMMARY OF THE INVENTION

It is an object of the present invention to provide an environmentally friendly cross-tie that overcomes all the problems with the above-discussed prior art.

The present invention provides a cross-tie made of recycled tire treads stacked and secured to one another in the configuration of a traditional-sized cross-tie. The cross-tie exhibits rigidity comparable to that of wooden cross-ties, can handle the load of passenger and freight traffic, and does not present any substantial harm to the environment. Moreover, since recycled tire treads often can be obtained at a negative cost (recyclers often pay for disposal of tire treads), cross-ties can be manufactured at an expense comparable to that of wooden cross-ties.

In accordance with one embodiment of the present invention, a cross-tie for a railroad rail assembly is provided that has a first dimension extending in a first direction, a length extending in a direction substantially perpendicular to the first direction, and a second dimension extending in a second direction substantially perpendicular to the first and length directions. The cross-tie includes a plurality (n) of recycled tire treads stacked and secured to one another in one of the first and second directions, and each layer has a length substantially coextensive with the length of the cross-tie, a width substantially coextensive with one of the height and width of the cross-tie, and a thickness equal to 1/n of the other one of the height and width of the cross-tie.

In accordance with a preferred embodiment of the present invention, a cemented elastomeric membrane layer is interposed between adjacent planar layers of the cross-tie to bond the layers to one another and form an integrally bonded body. When using recycled tire treads, the cemented membrane layer includes standard cement and membrane products, which are used in the same manner as typically used to retread or recap used tires. Examples of the membrane include CHEM GUM and PC CUSHION GUM (both manufactured by Patch Rubber Company), and examples of the cement include FIBERBOND brush type cement and HV CHEMICAL CEMENT (both manufactured by Patch Rubber Company).

In accordance with another embodiment of the present invention, a railroad rail assembly is provided that includes a pair of substantially parallel rails extending in a first direction, and a plurality of cross-ties supporting the rails and extending in a direction substantially perpendicular to the first direction. Each of the cross-ties includes a plurality of recycled tire treads stacked and secured to one another either along the first direction or in a direction normal to the first direction.

In accordance with a preferred method of manufacturing the cross-tie of the present invention, a plurality of recycled tire treads, each having a length substantially coextensive with the length of the cross-tie and a width substantially coextensive with one of the height and width of the cross-tie are stacked one upon another in the other one of the height and width directions of the cross-tie, and the stacked layers are secured to one another.

Again, a cemented membrane layer is interposed between adjacent tire treads, and it is preferred to use membrane and cement products typically used to retread or recap used tires.

The cross-tie of the present invention overcomes all the problems with the prior art cross-ties described above, because it is considerably more environmentally friendly than creosote-soaked cross-ties, exhibits rigidity comparable to that of wooden cross-ties, and can be manufactured at a price that makes it comparably priced to wooden cross-ties.

Another advantage of the present cross-tie is that, since its major component is rubber, it inherently acts as a vibration damper for the rails that it supports. This vibration damping characteristic reduces rail noise and preserves the integrity of the underlying rail bed, as less vibration from passing rail cars is transmitted to the rail bed.

BRIEF DESCRIPTION OF THE DRAWINGS

For a better understanding of the nature and objects of the invention, reference should be made to the following detailed description of a preferred mode of practicing the invention, read in connection with the accompanying drawings, in which:

FIG. 4 shows the cross-tie of FIGS. 1–3 supporting a railroad rail assembly (shown in partial cross-section);

FIG. 5 is a side view of a cross-tie in accordance with another embodiment of the present invention;

FIG. 6 is a top view of the cross-tie shown in FIG. 5; and

FIG. 7 is an exploded view of the cross-tie shown in FIG. 5.

DETAILED DESCRIPTION OF THE PREFERRED EMBODIMENT

Figure 1:
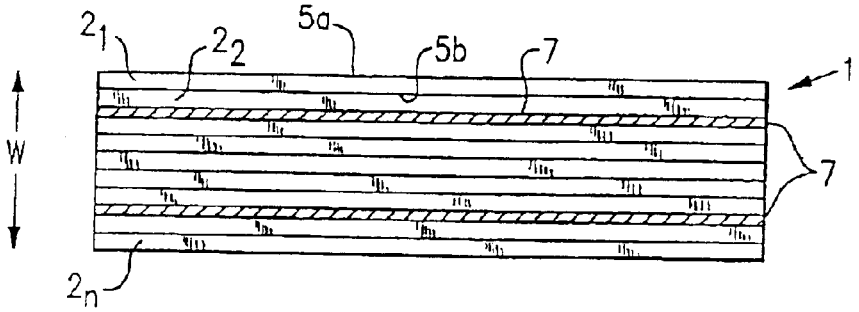
FIG. 1 is a top view of a cross-tie in accordance with one embodiment of the present invention.
Figure 2:
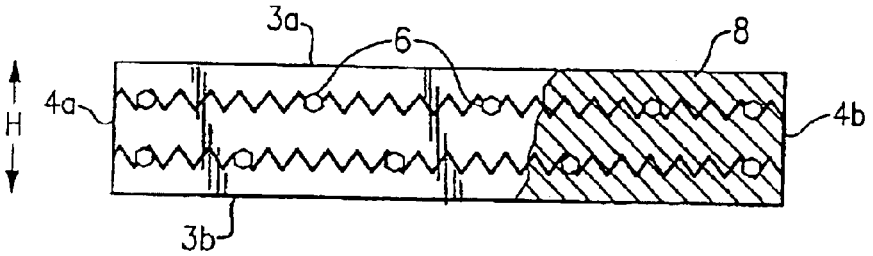
FIG. 2 is a side view of the cross-tie shown in FIG. 1, with the addition of a partial outer skin layer.
Figure 3:
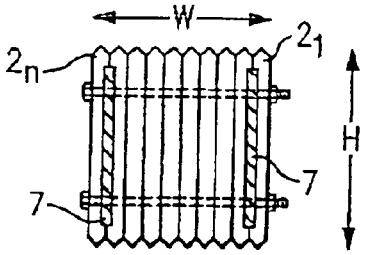
FIG. 3 is an end cross-sectional view of the cross-tie shown in FIG. 1.

The following description is provided with reference to FIGS. 1–4, wherein the tire treads are shown stacked along the width direction of the cross-tie. The invention also encompasses cross-ties wherein the tire treads are stacked along the height direction of the cross-tie, as shown in FIGS. 5 and 6. In the latter case, the "W" and "H" dimensions shown in FIGS. 1–4 would be reversed. That is, FIG. 1 would be a side view and FIG. 2 would be a top view. FIG. 3 would still be an end cross-sectional view, although rotated 90° about the longitudinal center of the cross-tie.

FIG. 1 shows a top view of a cross-tie in accordance with one embodiment of the present invention. The cross-tie 1 has a width W extending in a first direction (which is parallel to the extension of the rails to be supported by the cross-tie), a length L extending in a direction substantially perpendicular to the width direction, and a height H extending in a second direction (in and out of the paper in FIG. 1) substantially perpendicular to the first and length directions.

The cross-tie includes a plurality of layers $\mathbf{2}_1$, $\mathbf{2}_2$, . . . $\mathbf{2}_n$, each of which is a tire tread from a recycled tire. The tire treads are formed by cutting the sidewalls off of a tire at the junction between the tread and the sidewalls. The resultant tire tread includes the steel belt reinforcement layers from the original tire.

Each layer 2 includes a top side 3*a* and a bottom side 3*b*, as shown more clearly in FIG. 2. Each layer also includes a first end 4*a* and a second end 4*b*, as well as a front surface 5*a* and a back surface 5*b*.

The plurality of layers 2 are stacked (front surface of $2_2$ to back surface of $2_1$, etc.) along the width direction, which, again, extends in the same direction as the rails to be supported by the cross-tie. Since the layers 2 are stacked on their sides 3*b*, the width of each layer defines the height H of the cross-tie, which can be seen more clearly in FIG. 3. When the tire treads are arranged and secured in this fashion, they collectively exhibit more than sufficient strength to support a rail assembly. Moreover, the stacked layers also exhibit rigidity comparable to that of wooden cross-ties.

It is preferred that the adjacent layers are adhered together through interposed cemented membranes. When using tire treads to form the layers, typical elastomeric membranes used to retread or recap used tires are preferred. For example, membranes and cements sold by Patch Rubber Company under the tradenames of CHEM GUM and PC CUSHION GUM, and FIBERBOND and HV CHEMICAL CEMENT, respectively, are well suited for this application. In addition, the cementing operation can be performed under heated or room temperature conditions, depending upon the type of membrane and cement that is used.

Although there is no limitation on the thickness of the membrane, both 40 mil and 60 mil membranes provide sufficient adhesion between adjacent tires, so that the resultant stack of tires exhibits more than sufficient mechanical strength to function as a cross-tie.

It is also possible to incorporate one or more steel plates 7 between some of the adjacent layers 2. Although the steel plates 7 provide added strength in the height direction of the cross-tie, including steel plates in this capacity is ultimately cost prohibitive. In any event, the inventors discovered that, due to the surprising strength of the tire treads and interposed membranes alone, steel plates are not necessary in most cases, especially when the tire treads are stacked so as to lay flat and secured using an adhesive (see FIG. 7).

FIGS. 2 and 3 show that a plurality of fasteners 6 (e.g., galvanized nut-bolt-washer assemblies) extend through the stacked layers 2 along the direction of width of the cross-tie. If the layers are adhered together as explained earlier, the fasteners may not be necessary. The fasteners may still play a role, however, in holding the layers together while the cemented membrane layers set or cure. While there is no specific pattern required for the fasteners, they must be positioned so as not to interfere with the mechanism that will hold the rail to the cross-ties, as explained in more detail later herein.

It is also possible to secure the layers 2 to one another through a vulcanization process, either alone or in combination with the fasteners 6. If whole tires are used to implement manufacture of the cross-tie of the present invention, the sidewall rubber will be available as a scrap material that could be pulverized and interposed among the various layers 2. The layers, with the pulverized interposed rubber particles and other vulcanizing agents, could then be secured to one another through a conventional vulcanization process.

It is also possible to form a skin layer 8 covering at least a portion of an outer surface of the cross-tie, as shown in partial view in FIG. 2. Again, this skin layer could be formed from the rubber scrap from the sidewalls of the original tires. Such a skin layer could also include other additives, such as UV inhibitors, and the like.

As explained above, since layers 2 are formed from tire treads taken from recycled tires, the layers essentially comprise an elastomeric matrix and a reinforcing member (e.g., a steel belt) positioned within the matrix. It is within the scope of the present invention, however, to use other layer materials.

FIG. 4 shows the cross-tie of FIGS. 1–3 supporting rails 10 of a railroad rail assembly. The railroad rail assembly includes a rail connection mechanism 11 for securing the rails 10 to the cross-ties 1. The rail connection mechanism includes threaded members 12 extending through the cross-tie in the height direction thereof. The rails 10 are seated in top plates 13, which are positioned between the rails 10 and the top of the cross-tie 1. The threaded members (e.g., a bolt) are secured to a bottom plate 14 positioned beneath the cross-tie 1. In a preferred embodiment, the bottom plate 14 includes threaded holes for receiving the threaded members 12. It is also preferred that the bottom plate 14 be secured to the bottom of each cross-tie 1 through suitable fasteners (e.g., screws), so that the bottom plate can be transported as part of the cross-tie itself.

The cross-tie of the present invention can be used in the construction of new railroad rail assemblies, or to replace deteriorated wooden cross-ties. In the latter case, the cross-tie of the present invention can be simply inserted beneath the railroad rail assembly to replace the deteriorating wooden cross-tie. In such a case, it is not necessary to elevate the railroad rail assembly, since the threaded members 12 of the rail connection mechanism can be threaded from the top of the cross-tie into the threaded holes in the bottom plate 14 after the cross-tie is in position.

FIG. 5 is a side view of a cross-tie in accordance with another embodiment of the present invention, wherein the tire treads are stacked one upon another in the height direction of the cross-tie. In this case, the width of each tire tread or layer 2 is coextensive with the width W of the resultant cross-tie. The orientation shown in FIG. 5 is preferred, in some respects, compared to the orientation shown in FIGS. 1–4, since the rail connection mechanism 11 can employ standard railroad spikes extending into the various layers 2 of the cross-tie. Since there is no chance that the rail connection mechanism would penetrate an interface between two adjacent layers 2, as in the case of the orientation shown in FIG. 4, the durability of the rail connection mechanism and its attachment to the cross-tie is improved.

FIG. 6 is a top view of the cross-tie shown in FIG. 5, including fasteners 6 passing through all the layers 2 of the cross-tie. As shown in FIG. 6, the fasteners are spaced apart along the tie, such that one fastener exists on each end and three fasteners exist near the central region of the tie. This allows for sufficient fastening of the layers together, especially when combined with interposed cemented membranes, as discussed above. This arrangement of fasteners 6 also leaves more than sufficient room on the cross-tie for the rail connection spikes to be secured in the cross-tie without interference from the fasteners 6. Any arrangement of fasteners could be used.

FIG. 7 shows a partial exploded view of the cross-tie shown in FIG. 5, wherein the membranes $\mathbf{15}_1$, $\mathbf{15}_2 \ldots \mathbf{15}_n$ are shown interposed between adjacent tire treads. Although not shown in FIG. 7, as explained above, suitable cement would be applied between the opposed surfaces of each membrane 15 and the surface of each tire tread with which the membrane makes contact.

The cross-tie shown in the drawings is very simple and cost effective to manufacture. Again, the layers are most suitably made from recycled tire treads, which effectively provides a negative raw material cost.

In accordance with a preferred method of manufacture, used tires are cut to remove the side walls, and then the treads are inspected (e.g., visually and electronically) for defects. Accepted tread circles are buffed to remove tread rubber and to achieve the desired thickness, to shape the tread, and to prepare the surface for bonding. The inner surface is further prepared by buffing to remove silicone and a portion of the inner curve so the tread is as flat as possible. The tire treads are cut to a length equal to the length L of the desired cross-tie. If necessary, the width of each tire tread is also cut to match one of the height H and width W of the desired cross-tie. The other one of the height H and width W of the cross-tie is established by dividing the desired height or width of the cross-tie by the thickness of the tire treads, and then employing the appropriate number of tire treads to achieve the desired cross-tie height H or width W. For example, if each tire tread is one inch thick and the desired height or width of the cross-tie is ten inches, then ten tire treads would be used.

Once the tire treads are cut to the appropriate size, they are stacked with the sides 3*a*, 3*b* and ends 4*a*, 4*b* of each tread in substantial alignment, basically as shown in FIG. 1. The tire treads could be stacked on their sides or stacked flat one upon the other. This latter stacking direction will likely facilitate handling of the individual tire treads as it allows gravity to assist in maintaining the tire treads in position. The appropriate cement and membrane materials are interposed between adjacent layers as they are stacked (it may be desirable to roughen the surface of the tire treads to enhance adhesion of the cement). The layers are then pressed together (e.g., by using a press) and fasteners 6 are added at appropriate intervals. Once the cement has set or cured, excess adhesive is removed by grinding the sides of the stack. This grinding also evens the stacking, improves appearance, and brings the stack to its final size. The resultant cross-tie is then ready for use or stock storage.

If desired, steel reinforcing plates can also be positioned between one or more adjacent pairs of the tire treads, and then all the treads would be secured to one another using an appropriate fastening mechanism, such as that exemplified above.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A railroad rail assembly comprising:

a pair of substantially parallel rails extending in a first direction; and a plurality of cross-ties supporting said rails and extending in a length direction substantially perpendicular to said first direction, each of said cross-ties comprising a plurality of tire treads each having a length in said length direction and being stacked along one of said first direction and a second direction normal to said first direction, each of said tire treads having substantially straight and continuous side surfaces along said length thereof and being secured to one another via an interposed elastomeric membrane and adhesive, wherein at least one of the upper and lower surfaces of each said cross-tie is defined by at least one tire tread, and wherein the thickness of said elastomeric membrane is less than the thickness of said tire tread.

2. The assembly of claim 1, wherein the thickness of each of said tire treads extends in said second direction, the length of each said layer extends in said length direction, and the width of each said layer extends in said first direction.

3. The assembly of claim 1, wherein the thickness of each of said tire treads extends in said first direction, the length of each said layer extends in said length direction, and the width of each said layer extends in said second direction.

4. The assembly of claim 1, wherein said tire tread includes a reinforcement member therein.

5. The assembly of claim 1, further comprising a plurality of fasteners passing through said plurality of tire beads.

6. The assembly of claim 1, further comprising a rail connection mechanism for connecting each respective rail to each respective cross-tie, a portion of said rail connection mechanism extending into said cross-tie along said second direction.

7. The assembly of claim 1, wherein said tire treads are secured to one another through a vulcanization process.

8. A cross-tie for a railroad rail assembly, said cross-tie having a first dimension extending in a first direction, a length dimension extending in a length direction substantially perpendicular to said first direction, and a second dimension extending in a second direction substantially perpendicular to said first and length directions, said cross-tie comprising a plurality (n) of tire treads stacked in one of said first and second directions, said tire treads being secured to one another via an interposed elastomeric membrane and adhesive, each of said tire treads having a length substantially coextensive with the length of said cross-tie and having substantially straight and continuous side surfaces along said length thereof, a width substantially coextensive with one of the height and width of said cross-tie, and a thickness equal to 1/n of the other one of the height and width of said cross-tie, wherein at least one of the upper and lower surfaces of each said cross-tie is defined by at least one tire tread, and wherein the thickness of said elastomeric membrane is less than the thickness of said tire tread.

9. The cross-tie of claim 8, wherein said tire tread includes a reinforcement member therein.

10. The cross-tie of claim 8, further comprising a plurality of fasteners passing through said plurality of tire treads.

11. The cross-tie of claim 8, wherein said tire treads are secured to one another through a vulcanization process.

12. A method of manufacturing a cross-tie for a railroad rail assembly, the cross-tie having a first dimension extending an a first direction, a length dimension extending in a length direction substantially perpendicular to the first direction, and a second dimension extending in a second direction substantially perpendicular to the first and length directions, said method comprising the steps of:

providing a plurality (n) of tire treads, each having a length substantially coextensive with the length of the cross-tie and having substantially straight and continuous side surfaces along said length thereof a width substantially coextensive with one of the height and width of the cross-tie, and a thickness equal to 1/n of the other one of the height and width of the cross-tie;

stacking the tire treads one upon another; and securing the stacked tire treads to one another via an interposed elastomeric membrane and adhesive;

wherein at least one of the upper and lower surfaces of each said cross-tie is defined by at least one tire tread, and wherein the thickness of said elastomeric membrane is less than the thickness of said tire tread.

13. The method of claim 12, wherein said securing step further comprises positioning fasteners through the stacked tire treads.

14. The method of claim 12, wherein said securing step comprises a vulcanization treatment.

15. The method of claim 12, further comprising a step of buffing said tire treads before said stacking step.

16. The method of claim 12, further comprising a step of pressing said stacked tire treads.

17. The method of claim 12, further comprising a step of curing said adhesive material.

18. The method of claim 17, further comprising a step of grinding a side surface of said secured, stacked tire treads, thereby removing excess adhesive.

19. A cross-tie for a railroad rail assembly, comprising a plurality of tire treads stacked in a height dimension of the cross-tie, said tire treads being secured to one another via an interposed elastomeric membrane and adhesive, wherein each of said tire treads has substantially straight and continuous side surfaces along its length, at least one of the upper and lower surfaces of said cross-tie is defined by at least one tire tread, and the thickness of said elastomeric membrane is less than the thickness of said tire tread.

20. A cross-tie for a railroad rail assembly, comprising a plurality of recycled tire treads stacked in a width dimension of the cross-tie, said tire treads being secured to one another via an interposed elastomeric membrane and adhesive, wherein each of said tire treads has substantially straight and continuous side surfaces along its length, at least one of the upper and lower surfaces of said cross-tie is defined by side edges of the tire treads, and the thickness of said elastomeric membrane is less than the thickness of said tire tread.

* * * * *

UNITED STATES PATENT AND TRADEMARK OFFICE

CERTIFICATE OF CORRECTION

PATENT NO. : 6,824,070 B2 
DATED : November 30, 2004
INVENTOR(S) : Rick Halverson and Martin Diamond It is certified that error appears in the above-identified patent and that said Letters Patent is hereby corrected as shown below:

Title page,
Item [87], PCT Publication Date, change "Nov. 4, 2002" to -- Nov. 14, 2002 --

Signed and Sealed this

First Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,824,070 B2 
DATED : November 30, 2004
INVENTOR(S) : Rick Halverson and Martin Diamond It is certified that error appears in the above-identified patent and that said Letters Patent is hereby corrected as shown below:

Column 7,
Line 10, change "beads" to -- treads --
Line 12, change "an" to -- in --

Column 8,
Line 4, add -- , -- after "thereof"
Line 48, please insert the following claims:
-- 21. The assembly of claim 1, further comprising an outer skin layer covering at least a portion of an outer surface of each of said cross-ties.
22. The assembly of claim 21, wherein said outer skin layer comprises rubber.
23. The cross-tie of claim 8, further comprising an outer skin layer covering at least a portion of an outer surface of said cross-tie.
24. The cross-tie of claim 23, wherein said outer skin layer comprises rubber.
25. The method of claim 12, further comprising the step of forming an outer skin layer on at least a portion of an outer surface of each said cross-tie.
26. The method of claim 25, wherein said outer skin layer comprises rubber.
27. The cross-tie of claim 19, further comprising an outer skin layer covering at least a portion of an outer surface of said cross-tie.
28. The cross-tie of claim 27, wherein said outer skin layer comprises rubber.
29. The cross-tie of claim 20, further comprising an outer skin layer covering at least a portion of an outer surface of said cross-tie.
30. The cross-tie of claim 29, wherein said outer skin layer comprises rubber. --

Signed and Sealed this

Thirty-first Day of May, 2005

JON W. DUDAS
*Director of the United States Patent and Trademark Office*